US008631546B2

(12) United States Patent
Hesch, Jr.

(10) Patent No.: US 8,631,546 B2
(45) Date of Patent: Jan. 21, 2014

(54) SECURITY SYSTEM HARD TAG CLAMP AND CLAMPING METHOD

(75) Inventor: John Hesch, Jr., Orient, OH (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 338 days.

(21) Appl. No.: 12/876,754

(22) Filed: Sep. 7, 2010

(65) Prior Publication Data

US 2012/0055944 A1 Mar. 8, 2012

(51) Int. Cl.
*E05B 73/00* (2006.01)

(52) U.S. Cl.
USPC ..... 24/704.1; 340/572.1; 70/57.1

(58) Field of Classification Search
USPC ..... 24/602, 603, 704.1, 704.2; 70/57.1; 340/572.1, 572.8, 572.9
See application file for complete search history.

(56) References Cited

U.S. PATENT DOCUMENTS

| | | | | |
|---|---|---|---|---|
| 5,426,419 | A | 6/1995 | Nguyen et al. | |
| 5,528,914 | A * | 6/1996 | Nguyen et al. | 70/57.1 |
| 5,535,606 | A * | 7/1996 | Nguyen et al. | 70/57.1 |
| 5,687,459 | A | 11/1997 | Vanmoor | |
| 6,474,117 | B2 * | 11/2002 | Okuno | 70/57.1 |
| 6,535,130 | B2 * | 3/2003 | Nguyen et al. | 340/572.9 |
| 7,347,068 | B2 * | 3/2008 | Seidel | 70/57.1 |
| 7,633,396 | B2 * | 12/2009 | Lynce et al. | 340/572.8 |
| 8,269,632 | B2 * | 9/2012 | Hesch et al. | 340/572.8 |
| 2007/0024448 | A1 * | 2/2007 | Sayegh | 340/572.1 |
| 2011/0215156 | A1 * | 9/2011 | Johnson et al. | 235/492 |

FOREIGN PATENT DOCUMENTS

| | | | |
|---|---|---|---|
| EP | 1857622 | A2 | 11/2007 |
| WO | 03/071056 | A3 | 8/2003 |

OTHER PUBLICATIONS

EPO International Search Report dated Dec. 27, 2011 for corresponding appln PCT/US11/001497.

* cited by examiner

*Primary Examiner* — Robert J Sandy
*Assistant Examiner* — Louis Mercado
(74) *Attorney, Agent, or Firm* — Fox Rothschild, LLP; Robert J. Sacco; Carol E. Thorstad Forsyth

(57) ABSTRACT

A security tag that includes a mechanism for preventing the unauthorized removal of a security tag from its article. The security tag includes a housing having a clamp axis. A clamp is contained within the housing. The clamp is rotatable about the clamp axis from a locked position to an unlocked position. The clamp includes a lock region lockable to the housing, and a release region. The mechanism prevents the security tag from being removed from its article unless the lock region is unlocked from the housing and a force is applied to the release region.

14 Claims, 10 Drawing Sheets

SECURITY SYSTEM HARD TAG CLAMP AND CLAMPING METHOD

CROSS-REFERENCE TO RELATED APPLICATION n/a

STATEMENT REGARDING FEDERALLY SPONSORED RESEARCH OR DEVELOPMENT n/a

FIELD OF THE INVENTION

The present invention relates generally to security tags and more specifically to an apparatus for preventing the unauthorized removal of a security tag from the item to which it is attached.

BACKGROUND OF THE INVENTION

Security systems such as Electronic article surveillance (EAS) systems are known in the art for the prevention or deterrence of unauthorized removal of articles from a controlled area. In a typical EAS system, EAS markers (also known as tags or labels) are designed to interact with an electromagnetic field located at the exits of the controlled area, such as a retail store. These tags may also include radio frequency identification ("RFID") components. The tags are attached to the articles to be protected. As clever as security systems engineers have become in designing mechanisms to prevent the unauthorized removal of tags from the article to which it is attached, wrongdoers have become equally adept and coming up with clever ways to remove these tags and simply walk out of a store with the article undetected.

Many security tags include a pin that is inserted through the tag and secured in a clamp within the interior housing of the tag. These tags are often referred to as "hard tags" and are removed at the point-of-sale ("POS"). At the POS, a hook (e.g., such as the conventional probe 8 or external tool described in U.S. Pat. No. 5,426,419 to Nguyen et al.) is typically inserted through the tag, which rotates the clamp and releases the pin so that the tag can be safely separated from the item. Wrongdoers have created similar hooks that perform the same task, thus allowing them to remove the tags from the article prior to the POS. Needless to say, retail stores are looking for ways to overcome the cleverness of these wrongdoers by providing additional features that could be incorporated into the tag and which would prevent the pin from being withdrawn from the tag even if the hook is inserted within the tag and the tag's clamp rotated. However, methods that have been devised to accomplish this are either too cumbersome, too expensive, or make it extremely difficult for the cashier at the POS to remove the tag after an authorized purchase of an article.

Therefore, what is needed is a security tag that includes a mechanism to prevent the unauthorized removal of a security tag from its article by providing an additional deterrent to wrongdoers over and above the mere insertion of a hook within the tag while not interfering with the authorized removal of the tag from after an authorized purchase of the article.

SUMMARY OF THE INVENTION

The present invention advantageously provides a security tag and a method for detaching a security tag from an article that provides an added layer of protection such that the tag cannot be detached from its article only by inserting an arcuate member, such as a hook, within the tag to rotate the clamp to release the clamp from an attachment pin.

In one aspect of the invention, a security tag includes a housing having a clamp axis. A clamp that is contained within the housing is rotatable about the clamp axis from a locked position to an unlocked position. The clamp includes a lock region lockable to the housing, and a release region, where the clamp is rotatable to the unlocked position when the lock region is unlocked from the housing and a force is applied to the release region.

In another aspect, a security tag is provided where the security tag includes a housing defining an internal cavity, where the internal cavity has a ridge, the ridge including a groove therein. The tag also includes a clamp moveably positioned within the internal cavity, the clamp including an extension member, where at least a portion of the extension member removably resides within the groove. Movement of the clamp is prevented when the extension member resides within the groove.

In yet another aspect, a method for detaching an article from a security tag is provided. The security tag includes a clamp having a lock region and a release region, the clamp retaining a pin when in a locked position. The method includes unlocking the lock region and applying a force to the release region to unlock the clamp from the pin.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
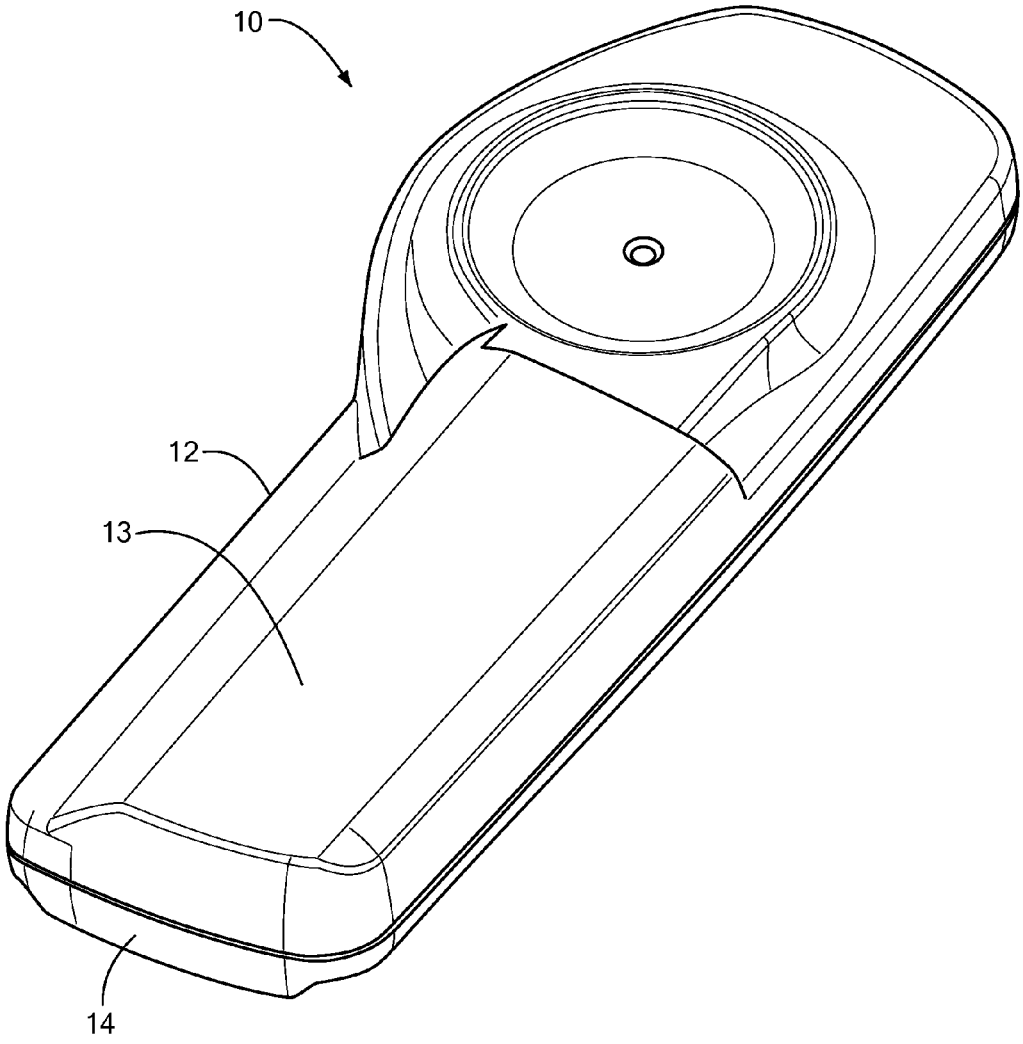
FIG. 1 is a top perspective view of a security tag housing constructed in accordance with the principles of the present invention.

Before describing in detail exemplary embodiments that are in accordance with the present invention, it is noted that the embodiments reside primarily in combinations of apparatus components and processing steps related to implementing a security tag that includes a mechanism which prevents the unauthorized removal of the security tag from its article by the insertion of a hook within the tag. The present disclosure provides a mechanism that implements an additional layer of tag detach security, rendering the insertion of a hook within the attachment clamp of the tag insufficient to separate the tag from its article on its own.

Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides a security tag, such as one used in an electronic article surveillance ("EAS") system, where the security tag includes an attachment clamp situated within the housing of the tag. The tag also includes a pin that is inserted through the article and locked to the clamp, securing the tag to its article. The clamp includes an aperture, the aperture receives a locking member that protrudes up through the aperture. The locking member resides within a channel extending up from the bottom section of the tag's housing. Within the channel and beneath the locking member is a spring which is biased to press upon the bottom of the locking member, extending the locking member through the aperture and engaging the attachment clamp. The engagement of the attachment clamp prevents the clamp from laterally rotating within the tag housing. Thus, while the insertion of a hook (e.g., such as that disclosed in the background section of this document) within the tag would normally rotate the clamp, releasing it from its attachment to the pin and allowing the pin to be removed and the tag removed from its article, because the locking member's engagement with the clamp prevents the lateral rotation of the clamp, mere insertion of a hook within the tag will not result in the removal of the pin.

The present disclosure will be understood more fully from the detailed description given below and from the accompanying drawings of particular embodiments of the invention which, however, should not be taken to limit the invention to a specific embodiment but are for explanatory purposes.

Referring now to the drawing figures in which like reference designators refer to like elements, there is shown in FIG. 1 an exemplary configuration of a security tag 10 according to an embodiment of the present invention. Security tag 10 includes a housing 12 that includes a top section 13 and a bottom section 14, forming a cavity within housing 12. The housing can be made of plastic. EAS and/or radio frequency identification ("RFID") components are contained within the cavity of housing 12.

Figure 2:
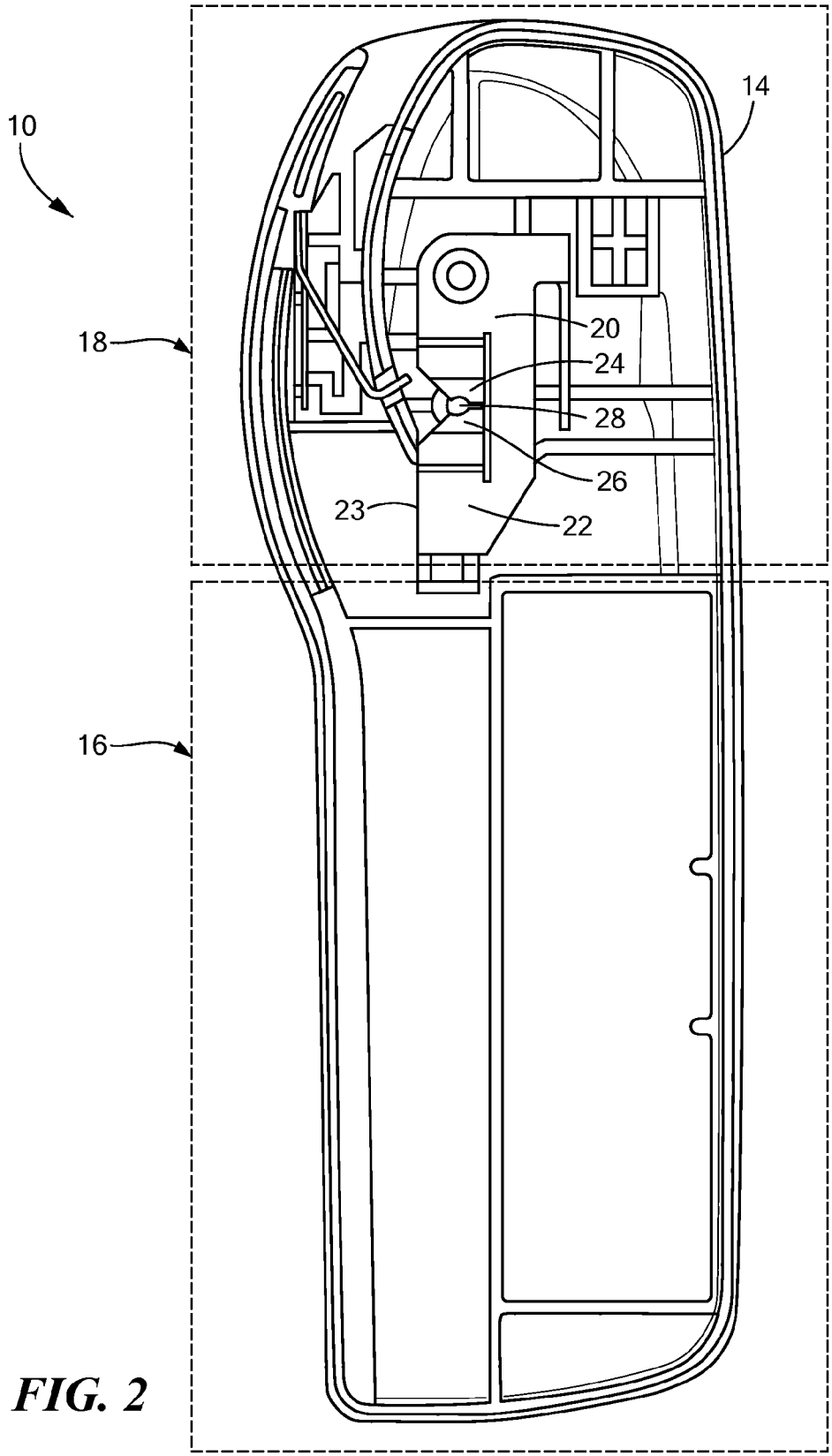
FIG. 2 is a top view of the bottom portion of the security tag of FIG. 1, showing the components therein including the attachment clamp.

Referring now to FIG. 2, bottom section 14 of tag 10 is shown, with top section 12 removed to show the components of tag 10 within housing 12. Tag 10 can include multiple chambers to house various components. Lower portion 16 of housing 12 contains the EAS or RFID components necessary to identify items in a corresponding EAS or RFID security system. These components, while necessary for the tag's function, are not within the scope of the present invention. An upper portion 18 of housing 12 includes an attachment clamp 20. Attachment clamp 20 rests on the bottom section 14 of tag 10 between various ridges and walls that retain clamp 20 so that it is not easily moved or rotated.

Attachment clamp 20 is typically metal and cooperates with an attachment element, such as a pin (not shown), to affix security tag 10 to an item to be secured (e.g. an article of clothing). Attachment clamp 20 includes a first lock region 22. Clamp 20 further includes two wing portions 24 and 26, which, at their end portions, form a small gap through which a pin can be inserted. The pin resides within gap 28, a small opening formed at the ends of wing portions 24 and 26. When inserted into gap 28, the pin cannot be removed unless attachment clamp 24 is laterally rotated, which also rotates wing portions 24 and 26 allowing the pin to be refracted from the space between wing portions 24 and 26, and tag 10 to be removed from its article. Clamp 20 also includes a release region 23. Clamp 20 can be rotated by the insertion of an arcuate member such as a hook within tag 10. The hook contacts release region 23 and forces clamp 20 to rotate laterally. This facilitates the removal of pin from tag 10.

Figure 3:
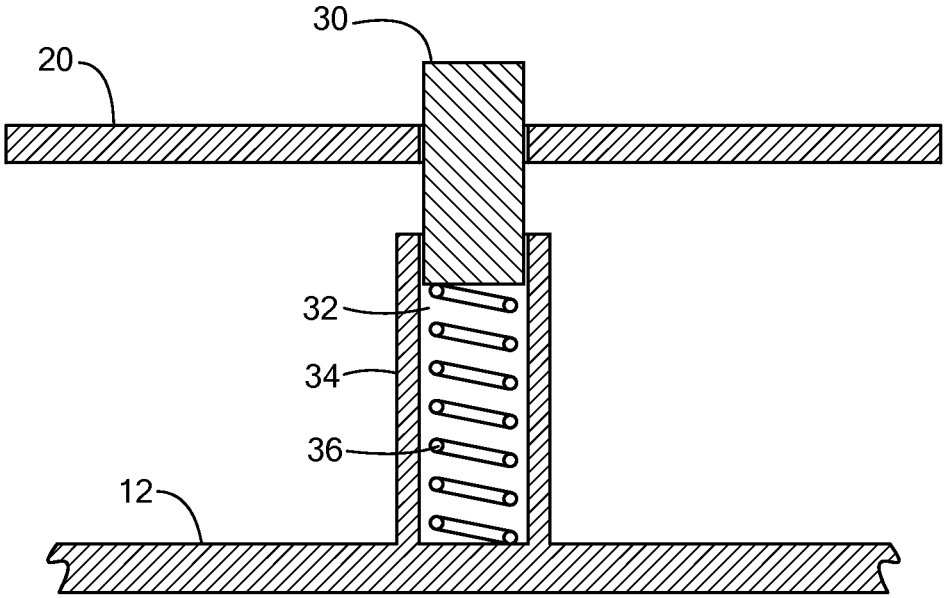
FIG. 3 is a side view of the extension member extending through the attachment clamp, in accordance with the principles of the present invention.

FIG. 3 is a side view showing one embodiment of attachment clamp 20. A locking member 30 protrudes through an aperture in clamp 20, thereby preventing clamp 20 from rotating when a detachment hook is inserted within tag 20 in order to turn or rotate clamp 20, which is the normal means of allowing the pin to be removed from the clamp and detaching tag 20 from its article. Locking member 30 is movable up and down within a channel 32. Channel 32 is formed within column 34, which in one embodiment extends upward from bottom section 14 of housing 12 toward top section 13. Locking member 30 can be made from a variety of materials, including ferrous and non-ferrous metal.

Referring again to FIG. 3, a spring 36 is situated below locking member 30 within channel 32. Spring 36 is biased such that spring 36 forces locking member 30 up through channel 32 and through an aperture (shown also in FIG. 4) within clamp 20. In this "locked" configuration, clamp 20 cannot be laterally rotated by conventional means, e.g. insertion of a hook to turn clamp 20, due to the engagement of locking member 30 with clamp 20. This is accomplished by the protrusion of the end of locking member 30 through the aperture in clamp 20. When tag 10 is brought up to a checkout counter to the point-of-sale ("POS"), locking member 30 can be retracted, thus disengaging it or "unlocking" it from clamp 20, and a conventional hook can be inserted within tag 20, rotating clamp 20, allowing the pin to be refracted and the tag 10 safely removed from its article.

Figure 4:
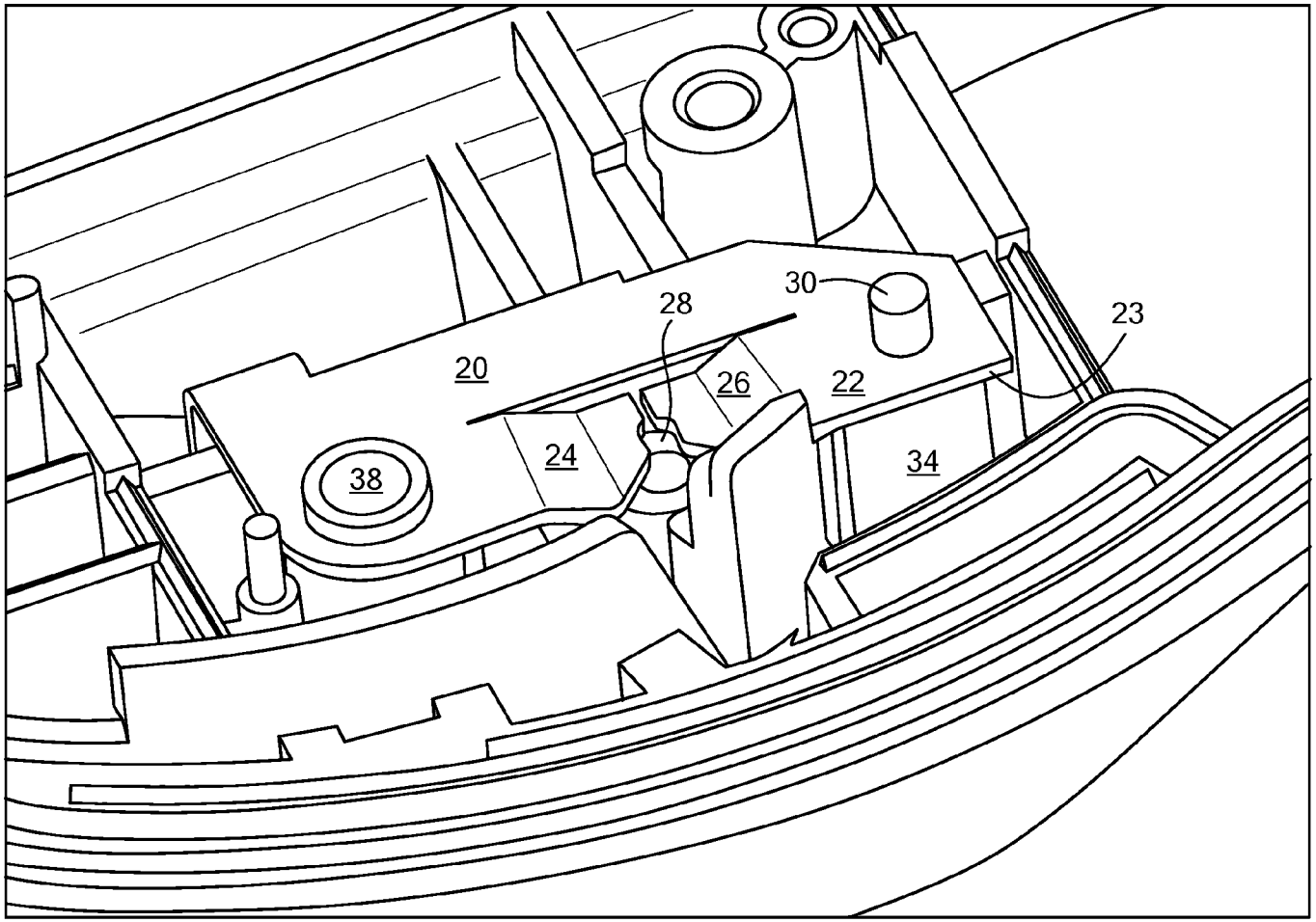
FIG. 4 is a top perspective view of the extension member extending through the attachment clamp, in accordance with the principles of the present invention.

FIG. 4 is a perspective view of clamp 20 showing its engagement with locking member 30. Column 34 can be seen extending upwards from the bottom section 14 of housing 12 and locking member 30 is shown protruding from within channel 32 of column 34 to engage clamp 20 at first lock region 22. Without the engagement of locking member 30 with clamp 20, clamp 20 would be free to rotate about axis point 38 when urged by a hook inserted within tag 10. First lock region 22 need not be located at any specific location on clamp 20. Thus, FIG. 4 shows only an exemplary location of first lock region 22. It is within the scope of the invention to provide other lock regions on clamp 20 where locking member 30 can engage clamp 20.

As clamp 20 is rotated, wing portions 24 and 26 are also rotated. Once wing portions 24 and 26 rotate, the pin can be easily removed. Advantageously, the present invention provides an additional level of tag detachment prevention by securing clamp 20 to housing 12 via the engagement of locking member 30 with clamp 20. This engagement, which occurs at an end of clamp 20 that is opposite the location of axis point 38 prevents the rotation of clamp 20. When an article is legitimately purchased, locking member 30 is retracted back within channel 32 and clamp 20 can be rotated by conventional means.

Figure 5:
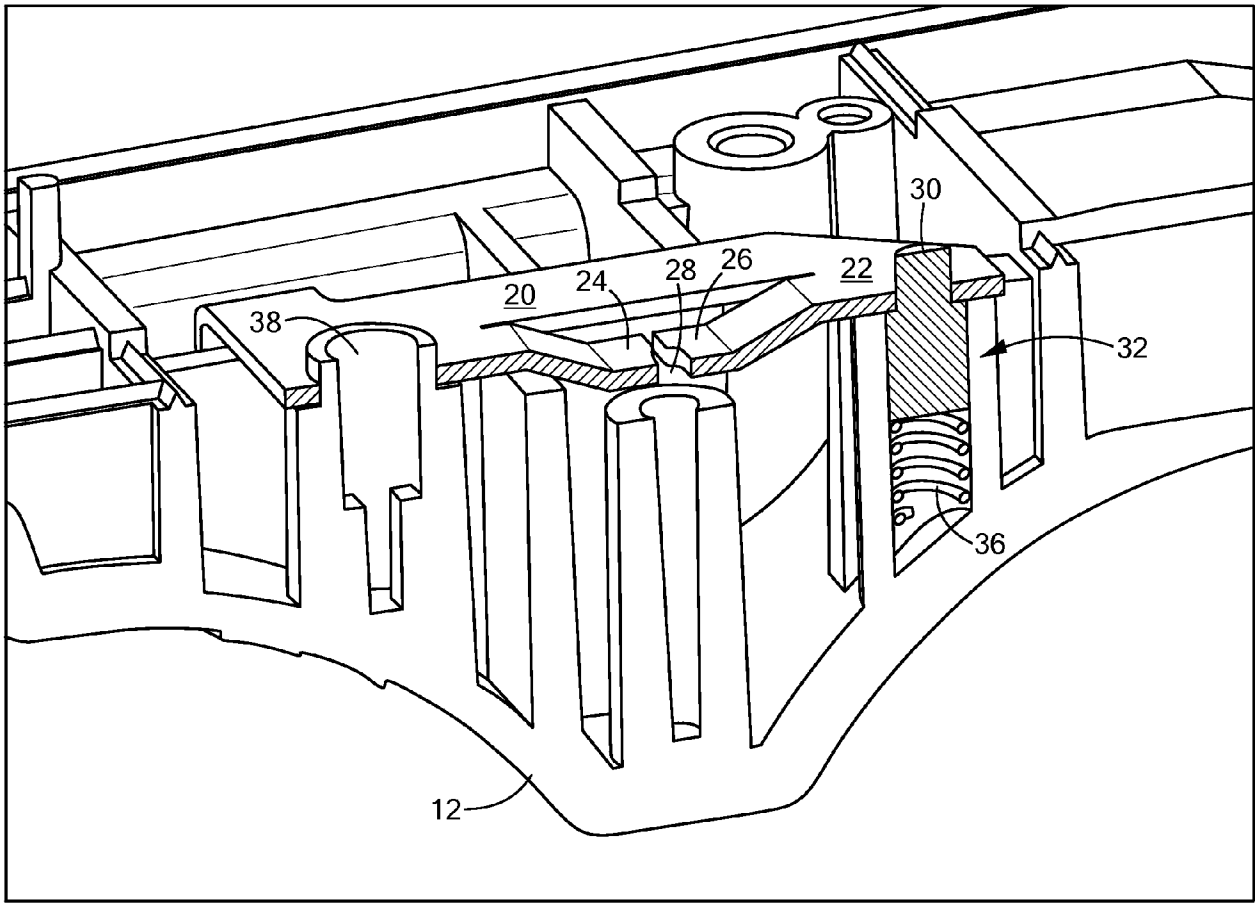
FIG. 5 is a top perspective cutaway view showing the extension member and the pocket through which the extension member protrudes and the spring within the pocket.

FIG. 5 is a cutaway view showing spring 36 situated within channel 32 and below locking member 30. Spring 36 is biased to exert an upward force on the bottom of locking member 30 to cause locking member 30 to protrude through the aperture in first lock region 22 of attachment clamp 20. Locking member 30 need not be of a specific length or diameter. However, its diameter should be of sufficient dimensions to fit within channel 32. Further, the length of locking member 30 needs to be long enough to project through the aperture in clamp 20 when spring 36 is extended and be short enough to drop below the aperture in clamp 20 when spring 36 is compressed. The tension of spring 36 and dimensions of locking member 30 can be altered in order to achieve an optimal arrangement.

Figure 6:
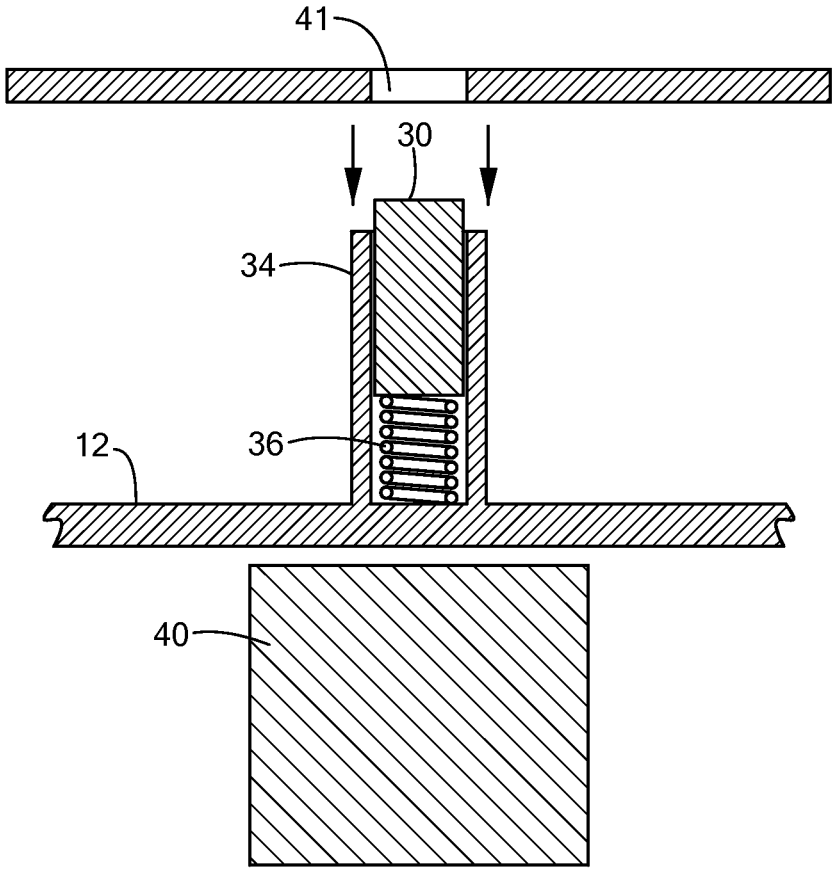
FIG. 6 is a side view showing a magnet used to disengage the extension member from the attachment clamp.

FIG. 6 illustrates one exemplary way which locking member 30 can be retracted within channel 32, thus disengaging locking member 30 from clamp 20. This disengagement is performed in order to allow, for example, the authorized removal of tag 10 from an article by conventional means, i.e., the insertion of a hook within tag 10 that rotates clamp 20 and allows for the removal of the pin. Locking member 30, in this embodiment, is made of a ferrous metal. A magnet 40 is brought near enough to the ferrous metal member 30 to attract it, which then retracts locking member 30 from an aperture 41 in clamp 20, and compresses spring 36. This serves to disengage clamp 20 and allows clamp 20 to be rotated by conventional means. Other methods of retracting locking member 30 can be used such as the insertion of a pin within or beneath column 34 to either compress spring 36 or to lower locking member 30 until locking member 30 is retracted from aperture 41.

Figure 7:
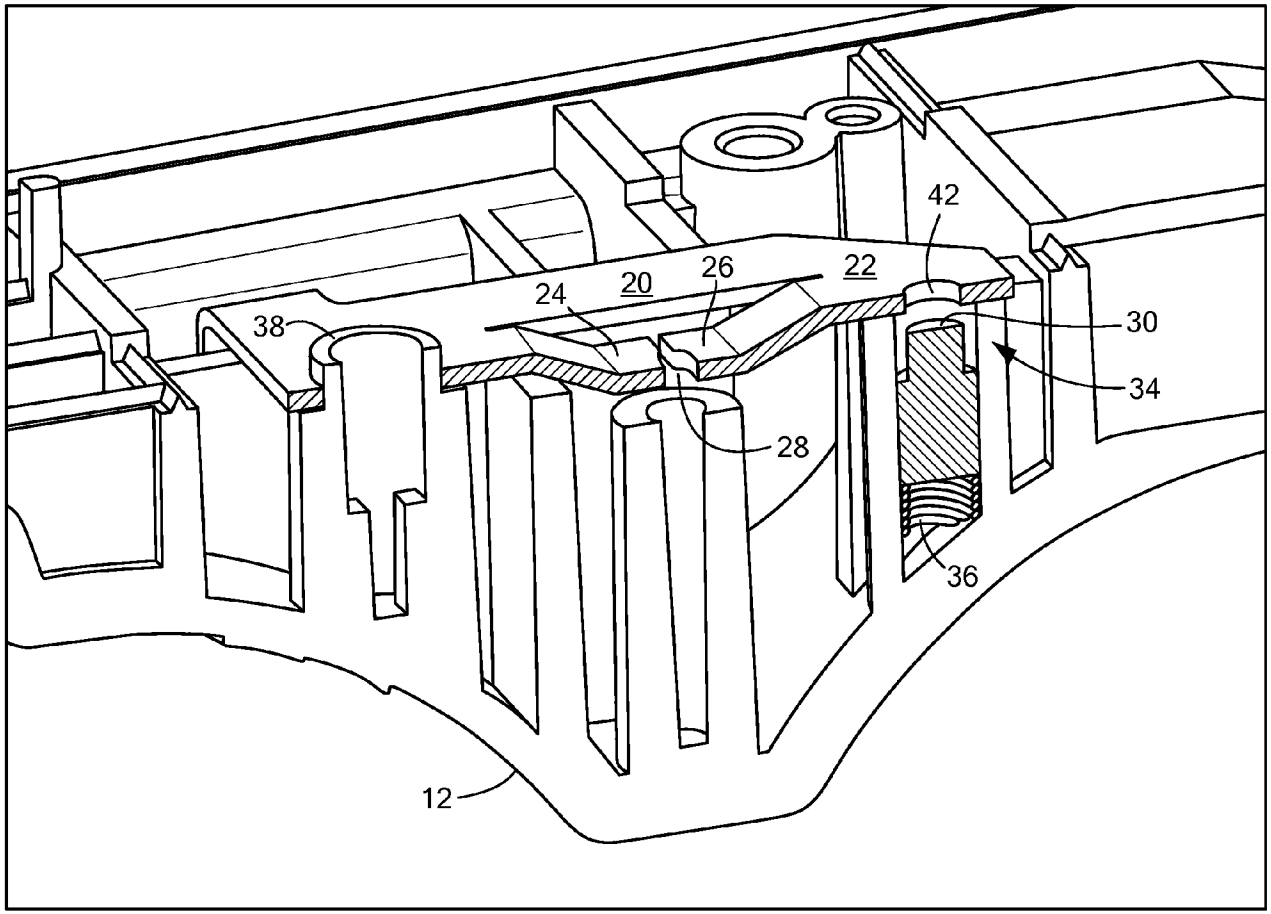
FIG. 7 is a top perspective cutaway view showing the extension member within the pocket in a refracted position.

FIG. 7 shows clamp 20 with locking member 30 retracted within channel 32. Locking member 30 can be retracted by the placement of magnet 40 near it or by other retraction methods. After retraction of locking member 30, clamp 20 is no longer prevented from being rotated. Therefore, the pin that is inserted within gap 28 between wing portions 24 and 26 can be removed by insertion of a hook within tag 10 to rotate clamp 20.

Figure 8:
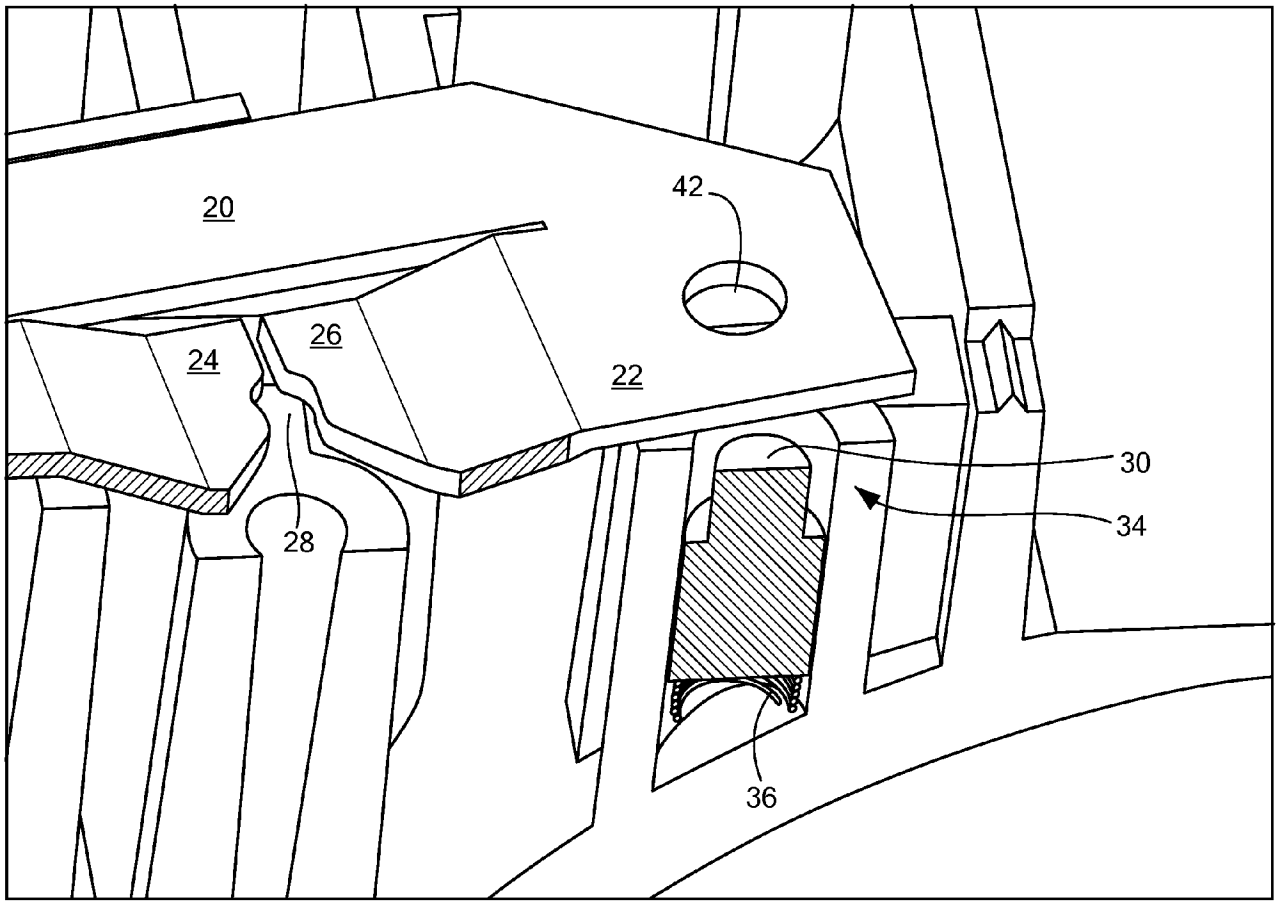
FIG. 8 is a top perspective view showing the extension member in a retracted position and the attachment clamp rotated such that the pin can be removed.

FIG. 8 shows clamp 20 after locking member 30 has been retracted and clamp 20 rotated. Once clamp 20 is rotated the attachment pin can be removed from between wing portions 24 and 26. This becomes possible only when locking member 30 is in the retracted position as shown. While locking member 30 remains engaged with clamp 20, clamp 20 cannot be rotated by conventional due to the second "anchor" provided by the detachment mechanism of the present invention. Advantageously, spring 36 provides a convenient and easy way for locking member 30 to move up and down within channel 32. When tag theft prevention is desired, spring 36 is extended, forcing locking member 30 to engage clamp 20. When tag theft prevention is not desired, e.g., after an article has been purchased, spring 36 is compressed, which retracts locking member 30 into channel 32, thus allowing clamp 20 to be rotated.

Figure 9:
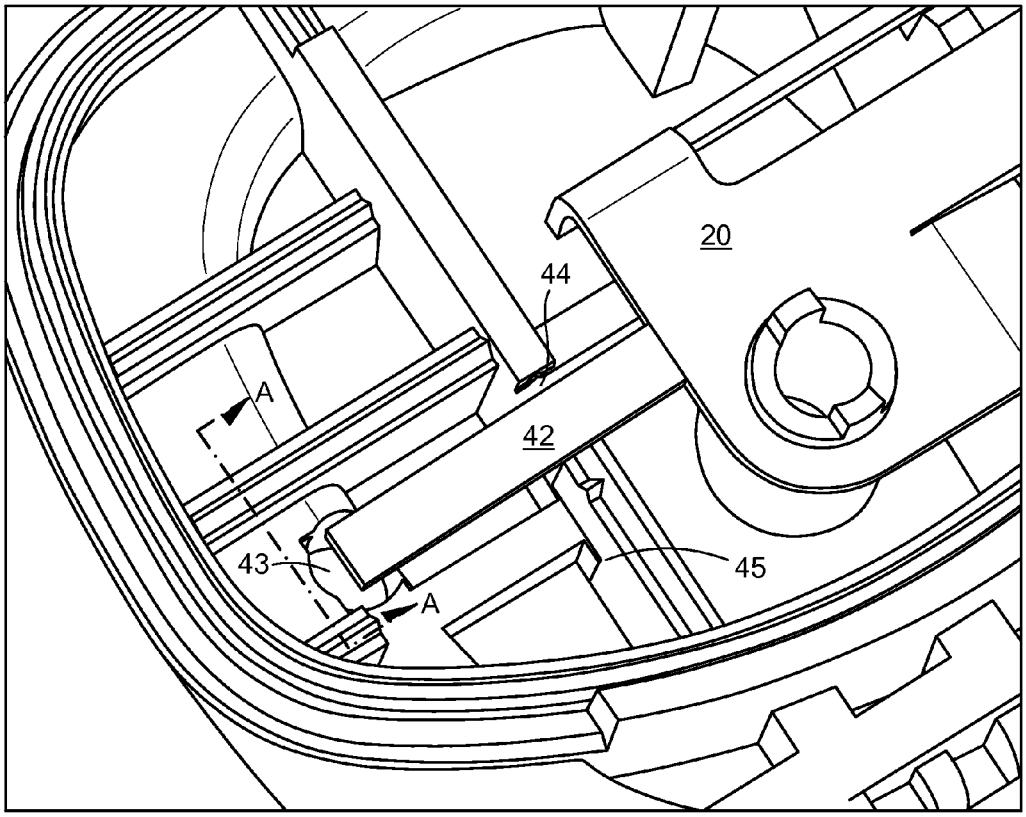
FIG. 9 is a top view of an alternate embodiment of the present invention.

FIG. 9 shows an alternate embodiment of the present invention. This embodiment performs the same function as the earlier embodiment, namely, preventing a wrongdoer from separating an article from its tag 10 by reproducing a hook that can slide within the tag and rotate attachment clamp 20 such that the pin can be removed. In this embodiment, an extension member or second lock region 42 is affixed at one end to the end of clamp 20. The opposite end of second lock region 42 extends toward upper portion 18 of tag 10. Second lock region 42 resides within a groove 44 cut into a ridge 45 within the internal cavity of housing 12. In one embodiment, the ridge runs parallel to the transverse axis of the bottom section 14 of the internal cavity of housing 12. The engagement of second lock region 42 within groove 44, serves to "lock" clamp 20 to housing 12. Second lock region 42 is shown in FIG. 9 as extending from the end of clamp 20, which resides within the internal cavity of housing 12. However, it is within the scope of the present invention to include a lock region at other locations of clamp 20, depending upon differently shaped and sized clamps 20.

Figure 10:
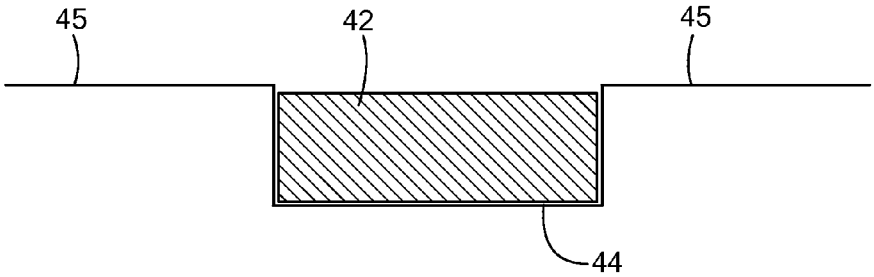
FIG. 10 is a side view of the security tag shown in FIG. 9.

This embodiment can also be seen in the side view of FIG. 10. Second lock region 42 rests between side walls of ridge 45 that form groove 44 thus preventing second lock region 42 from moving in a direction transverse to the longitudinal axis of housing. Because second lock region 42 cannot be moved laterally and because second lock region 42 is part of or is affixed to clamp 20 (shown in FIG. 9), clamp 20 is also prevented from being moved laterally or rotated. Thus, as long as second lock region 42 resides within groove 44 and is not lifted above the side walls of ridge 45, clamp 20 cannot be rotated and the pin within gap 28 cannot be removed. Advantageously, this provides an added layer of tag detachment prevention to the conventional hook method that rotates the clamp 20.

FIGS. 9 and 10 illustrate one method of preventing second lock region 42 from lateral movement by providing groove 44 within a ridge in housing 12, thus retaining second lock region 42 therein. Other methods for preventing second lock region 42 from lateral movement are also contemplated. For example, a retention clasp can extend from bottom section 14 through which second lock region 42 can be inserted. The retention clasp can be designed such that it can be pried open to insert second lock region 42 but will prevent the lifting of second lock region 42 without undue effort. An opening 43 can be formed in bottom section 14 of housing 12 allowing for the insertion of a release element such as a rod that presses upward upon the tip of second lock region 42, thus releasing second lock region 42 from groove 44. This can be done at the POS when an item is legitimately purchased.

Figure 11:
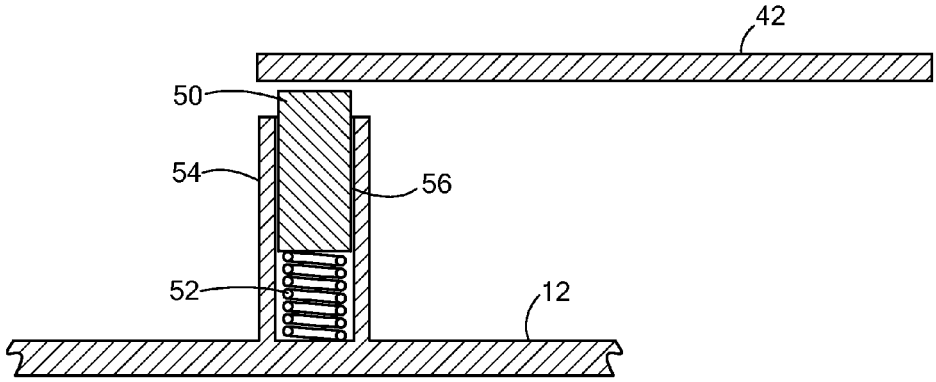
FIG. 11 is a top view of yet another embodiment of the present invention with a release element in a retracted position.

FIG. 11 shows yet another embodiment of the present invention. In this embodiment, in addition to second lock region 42 preventing rotation of clamp 20 due to second lock region 42 residing in retention groove 44, a release plunger 50 is used to assist in raising second lock region 42 high enough to clear groove 44. As shown in FIG. 11, release plunger 50 resides in a channel 56 extending from housing 12, within column 54. Spring 52 also resides within channel 56. Spring 52 is normally biased in a retracted position thus retaining release plunger 50 within channel 56 and below second lock region 42. Thus, release plunger 50 in combination with spring 52 form a release element that urges lock region 42 out of groove 44 in order to allow for clamp 20 to be rotated.

Figure 12:
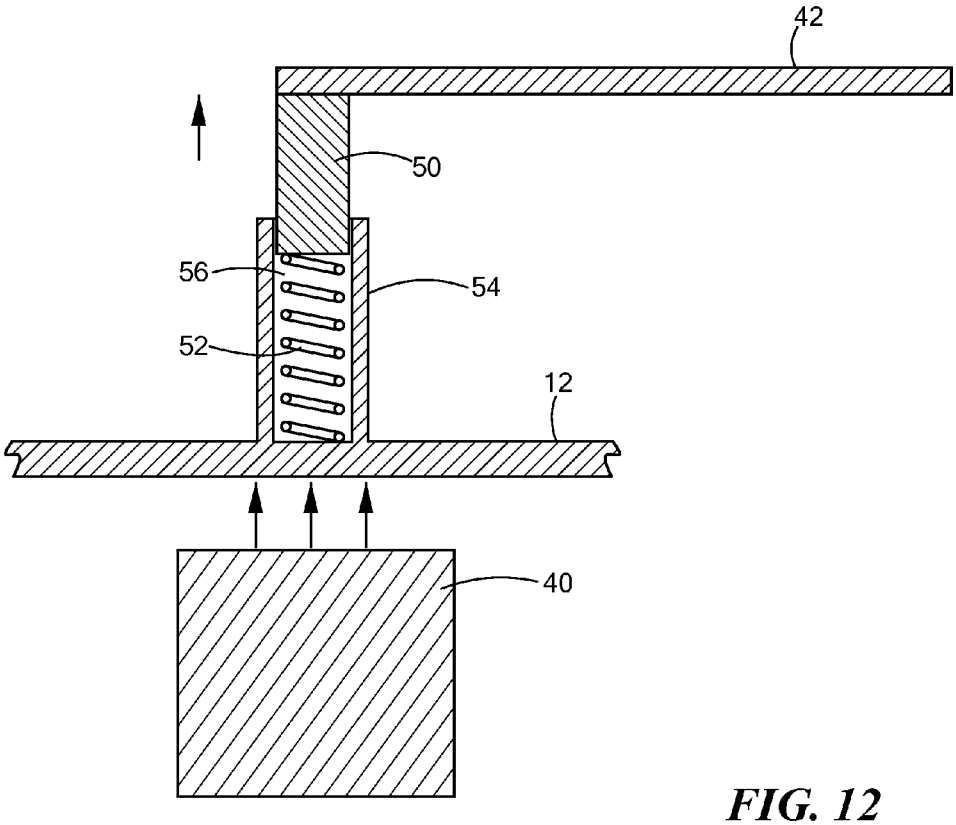
FIG. 12 is a top view of the embodiment shown in FIG. 11 with the release element in an extended position.

In FIG. 12, release plunger 50 is pushed upward by the exertion of a magnetic force, contacting second lock region 42. This causes second lock region 42 to be released from groove 44. Thus, this method provides another way of allowing a cashier at the POS to detach tag 10 from its article. A magnet 40, for example, can be used to apply upward force on release plunger 50, which could be made of ferrous material. After purchase of the article, a cashier can apply magnet 40, which raises release plunger 50 from its channel 56 and allows contact to be made between release plunger 50 and second lock region 42. This raises second lock region 42 out of groove 44 thus allowing the cashier to remove tag 10 from its article by conventional means such as by insertion of an arcuate hook within tag 10 in order to rotate clamp 20 and release the pin.

Thus, in embodiments discussed above and illustrated in the figures, the present invention advantageously provides two additional mechanisms to prevent the unauthorized removal of tag 10 from its article. In a first embodiment, as shown in FIGS. 3-8, a locking member 30 can be raised through aperture 41 in clamp 20 in order to engage the clamp and prevent any lateral rotation of the clamp 20. Locking member 30 can be raised and lower by use of magnet 40 and spring 36. In a second embodiment, second lock region 42 is provided at an end region of clamp 20. Second lock region 42 rests within groove 44 thus preventing its lateral movement. Rotation of clamp 20 is also prevented and the attachment pin cannot be removed from gap 28 until second lock region 42 is released from groove 44. As but two examples, second lock region 42 can be released from groove 44 by the application of a rod or other element through an opening in housing 12 or by using release plunger 50 to press upward against second lock region 42 thus raising second lock region 42 out of groove 44, such that clamp 20 can be rotated by insertion of an arcuate hook or by other conventional means.

While certain features of the embodiments have been illustrated as described herein, many modifications, substitutions, changes and equivalents will now occur to those skilled in the art. It is therefore to be understood that the appended claims are intended to cover all such modifications and changes as fall within the true spirit of the embodiments.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A security tag, comprising:

a housing;

a clamp securely disposed within the housing such that the clamp is pivotable about a first axis and movable by an external tool between a locked position in which an attachment element is releasably locked to the clamp and an unlocked position in which the attachment element is unlocked from the clamp;

a locking member disposed within the housing adjacent to the clamp and movable between an engaged position in which lateral rotation of the clamp by the external tool is inhibited and an unengaged position in which lateral rotation of the clamp by the external tool is permitted.

2. The security tag of claim 1, wherein the clamp has an aperture through which the locking member protrudes when the locking member is in the engaged position.

3. The security tag of claim 2, further comprising a spring configured to urge the locking member through the aperture when in a pre-stressed shape, and allows the locking member to retract from the aperture when in a compressed shape.

4. The security tag of claim 3, wherein the locking member comprises of a ferrous material.

5. The security tag of claim 4, wherein the spring transitions between the pre-stressed shape and the compressed shape in response to a magnetic field applied upon the locking member.

6. The security tag of claim 3, wherein the housing further comprises a column extending transversely away from a surface thereof and forming a channel sized and shaped to receive the locking member and the spring.

7. The security tag of claim 1, wherein the housing further comprises a ridge having a groove formed therein in which at least a portion of the locking member coupled to the clamp resides when the locking member is in the engaged position.

8. The security tag of claim 7, wherein the housing has an opening sized and shaped to permit insertion of a release element into the housing for urging the portion of the locking member from the groove.

9. A security tag, comprising:

a housing defining an internal cavity having a ridge with a groove formed therein;

a clamp securely disposed within the internal cavity of the housing such that the clamp is pivotable about a first axis and movable by an external tool between a locked position in which an attachment element is locked to the clamp and an unlocked position in which the attachment element is unlocked from the clamp; and an extension member coupled to the clamp and at least partially removably residing within the groove such that movement of the clamp by the external tool is inhibited thereby.

10. The security tag of claim 9, further comprising a release element configured to remove the extension member from the groove such that movement of the clamp by the external tool is permitted.

11. The security tag of claim 10, wherein the release element comprises:

a plunger movable between an unengaged position and an engaged position in which the plunger applies a force on the extension member such that the extension member is removed from the groove; and a spring operable to transition the plunger between the unengaged position and the engaged position.

12. The security tag of claim 11, wherein the plunger comprises a ferrous rod.

13. The security tag of claim 12, wherein the plunger transitions from the unengaged position to the engaged position in response to a magnetic field applied thereto.

14. The security tag of claim 10, wherein the housing further comprises a column forming a channel sized and shaped to receive at least a portion of the release element.

* * * * *